US008925454B2

(12) United States Patent
Faber

(10) Patent No.: US 8,925,454 B2
(45) **Date of Patent: *Jan. 6, 2015**

(54) INK STORING UNIT FOR A HAND-OPERATED STAMP

(71) Applicant: Colop Stempelerzeugung Skopek Gesellschaft m.b.H. & Co. KG, Wels (AT)

(72) Inventor: Ernst Faber, Wels (AT)

(73) Assignee: Colop Stempelerzeugung Skopek Gesellschaft m.b.H. & Co. KG, Wels (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/169,366

(22) Filed: Jan. 31, 2014

(65) Prior Publication Data

US 2014/0144339 A1 May 29, 2014

Related U.S. Application Data

(63) Continuation of application No. 13/521,150, filed as application No. PCT/AT2011/000043 on Jan. 27, 2011, now Pat. No. 8,789,463.

(30) Foreign Application Priority Data

Jan. 27, 2010 (AT) ..... A 109/2010

(51) Int. Cl.

| | |
|---|---|
| ***B41F 3/00*** | (2006.01) |
| ***B41K 1/38*** | (2006.01) |
| ***B41K 1/42*** | (2006.01) |
| ***B41K 1/54*** | (2006.01) |
| ***B41K 1/02*** | (2006.01) |
| ***B41K 1/40*** | (2006.01) |
| ***B41K 1/50*** | (2006.01) |

(52) U.S. Cl.
CPC ... *B41K 1/54* (2013.01); *B41K 1/02* (2013.01); *B41K 1/38* (2013.01); *B41K 1/40* (2013.01); *B41K 1/50* (2013.01)
USPC ..... 101/333; 101/327; 101/406

(58) Field of Classification Search
CPC ..... B41K 1/00; B41K 1/38; B41K 1/40; B41K 1/42; B41K 1/50; B41K 1/54; B41K 3/54; B41K 1/006; B41F 17/001
USPC ..... 101/327, 333, 395, 401.1, 405, 406
See application file for complete search history.

(56) References Cited

U.S. PATENT DOCUMENTS 5,974,969 A * 11/1999 Okumura et al. ..... 101/327
6,047,638 A 4/2000 Taira (Continued)

FOREIGN PATENT DOCUMENTS

AT 503 112 A4 8/2007
CN 2056125 U 4/1990

(Continued)

OTHER PUBLICATIONS

International Search Report of PCT/AT2011/000043, mailed Mar. 28, 2011.

(Continued)

*Primary Examiner* — Judy Nguyen
*Assistant Examiner* — Marissa Ferguson Samreth
(74) *Attorney, Agent, or Firm* — Collard & Roe, P.C.

(57) ABSTRACT

An ink-storage unit for a hand stamp includes a retainer in which a storage body is arranged, and a frame in which a printing plate is arranged. The frame sits in a provisional mounting position on the retainer, in which position the storage body and the printing plate are held at a distance from each other, and the frame can be moved into a final mounting position on the retainer, in which position the storage body and the printing plate lie against each other, wherein the storage body is fixed in the retainer by at least one engaging part.

8 Claims, 8 Drawing Sheets

(56) References Cited

U.S. PATENT DOCUMENTS

| | | | | |
|---|---|---|---|---|
| 6,112,662 | A | 9/2000 | Okumura et al. | |
| 6,892,637 | B2 * | 5/2005 | Petersen | 101/333 |
| 7,096,785 | B2 * | 8/2006 | Petersen | 101/333 |
| 8,104,402 | B2 | 1/2012 | Feilecker et al. | |
| 8,141,486 | B2 | 3/2012 | Faber | |
| 8,408,125 | B2 | 4/2013 | Feilecker et al. | |
| 2002/0069776 | A1 | 6/2002 | MacNeil | |
| 2004/0083912 | A1 | 5/2004 | Kitahara et al. | |
| 2005/0061175 | A1 | 3/2005 | Sculler | |
| 2006/0191431 | A1 | 8/2006 | Moody | |
| 2008/0053325 | A1 | 3/2008 | Humal | |
| 2009/0101032 | A1 * | 4/2009 | Slane et al. | 101/333 |
| 2010/0251912 | A1 * | 10/2010 | Feilecker et al. | 101/333 |
| 2012/0006214 | A1 | 1/2012 | Feilecker et al. | |

FOREIGN PATENT DOCUMENTS

| | | | | | |
|---|---|---|---|---|---|
| DE | 697 05 913 | T2 | | 4/2002 | |
| DE | 699 09 391 | T2 | | 4/2004 | |
| EP | 0 572 218 | A2 | | 12/1993 | |
| EP | 0 990 534 | A1 | | 4/2000 | |
| EP | 1 805 032 | B1 | | 8/2008 | |
| GB | 2 226 985 | A | | 7/1990 | |
| JP | 55-025998 | U | | 2/1980 | |
| WO | 2007082330 | | * | 1/2007 | B41K 1/02 |

OTHER PUBLICATIONS

Austrian Office Action dated Dec. 1, 2010 in Austrian Patent Application No. A 109/2010 with English translation of the relevant parts.
Chinese Office Action in 201180007341.6 dated Feb. 7, 2014.

* cited by examiner

INK STORING UNIT FOR A HAND-OPERATED STAMP

CROSS-REFERENCE TO RELATED APPLICATIONS

This application is a continuation of U.S. patent application Ser. No. 13/521,150, filed on Jul. 9, 2012, which is the National Stage of PCT/AT2011/000043 filed on Jan. 27, 2011, which claims priority under 35 U.S.C. §119 of Austrian Application No. A 109/2010 filed on Jan. 27, 2010, the disclosure of which is incorporated by reference. The international application under PCT article 21(2) was not published in English.

BACKGROUND OF THE INVENTION

The invention relates to an ink-storage unit for a hand stamp, including a retainer in which a storage body is arranged, and a frame in which a printing plate is arranged, wherein in a provisional mounting position the frame sits on the retainer, in which position the storage body and the printing plate are held at a distance from each other, and the frame can be moved into a final mounting position on the retainer, in which position the storage body and the printing plate lie against each other.

The invention further relates to a hand stamp comprising such an ink-storage unit and an actuating device for moving the printing plate arranged in the retainer from a resting position retracted in a housing into a printing position.

From the prior art, pre-inked hand stamps including ink storage units are known, in which so-called flash systems are used to produce printing plates having individually adaptable printing patterns, such a flash system being based on exposing an open-pore foam body provided for forming the printing plate to short-term exposures (flashes). The flashes cause the pores of the foam body to close in those regions where no stamp imprint is to be produced, wherein the printing plate, in order to obtain the desired stamp pattern, is introduced into an exposure machine together with a foil comprising said stamp pattern. To supply the printing plate with stamping ink, a separate storage body impregnated with stamping ink is usually provided. A hand stamp of this type is, for instance, described in AT 503 112 B1.

From European Patent EP 1 805 032 B1, a hand stamp in which the printing plate is formed by an exposed foam body is known. In that case, the printing plate and the storage body are each disposed in a separate frame part and retaining part, respectively, which parts are mutually engaged in a provisional position in such a manner that the printing plate and the storage body are arranged in a spaced-apart relationship while forming an air gap. The printing plate is fixed in its frame part by the aid of nipple projections preventing the printing plate from contacting the storage body. During the exposure operation in an exposure machine, the frame parts are disposed between a pressing plate and a glass plate. By applying a contact pressure, said parts are pushed together into a final position, in which the printing plate and the storage body contact each other for exchanging stamping ink. In the shown ink storage unit, the fixed fastening by gluing of the ink storage in its retaining part is disadvantageous, since the adhesive connection may come loose during operation, or gluing will not be possible, or only insufficiently possible, when using certain synthetic materials like polypropylene etc. for the retaining parts.

U.S. 2009/0101032 A1 describes a self-inking hand stamp of another type, in which the stamp unit is provided in a single mounting position. The stamp comprises a stamp housing in which a coupling part including two refill nozzles is disposed and which, by actuating a handle portion, is pressed on an ink storage contacting a stamp plate. An exposed foamed material forming the desired stamp pattern is provided as stamp plate. To fix the ink storage in the single mounting position, projections penetrating into the ink storage are provided on the lower side of the coupling part.

A further stamp device, which merely provides a single mounting position, is described in DE 697 05 913 T2. That stamp device comprises a stamp plate which is fixed on its longitudinal side by a pair of claws elastically engaging the stamp plate.

DE 699 09 391 T2 describes a stamp unit including an apron part, a holder displaceably arranged within the apron part, and a stamp material that is pressed against a stamp sheet upon actuation of a handle portion. The holder comprises bending portions fixing the stamp material by the aid of an interposed sealing agent.

A stamp having a stripping foil is known from EP 0 572 218 A2.

SUMMARY OF THE INVENTION

The object of the present invention is to provide an ink storage unit for a hand stamp of the initially-defined kind, which enables a structurally simple and permanently reliable fixation of the storage body within the retainer.

In accordance with the invention, this is achieved in that the storage body is fixed in the retainer by at least one engaging part. The engaging part enables the immovable fixation of the storage body within the retainer as soon as the engaging part enters into engagement with the storage body. An unreliable adhesive connection can thus advantageously be renounced. The fixation according to the invention, of the storage body with the engaging part is not subject to any limitations as to the selection of materials for the retainer, which has disadvantageously been the case with the known adhesive connections. In a preferred embodiment, the engaging part at least partially penetrates into the storage body, thus establishing a frictional and positive connection between the engaging part and the storage body. Alternatively, it will be advantageous, in particular where damage to the storage body is to be avoided, if the engaging part merely causes a local elastic deformation of the storage body during the engagement of the storage body and the fixation of the storage body is predominantly realized by a frictional engagement.

In a first preferred embodiment of the invention, it is provided that the engaging part is comprised of lugs provided on the retainer and engaging the storage body in a deformed or bent state. The lugs are preferably disposed on a wall facing the frame, of the particularly trough-shaped retainer. When pushing the frame onto the retainer, the lugs are bent or folded by the facing portions of the frame, which is preferably trough-shaped to conform with the retainer, and pressed into the storage body to fix the storage body within the retainer. It would, of course, be conceivable to provide just a single deformable or bendable lug; yet, in a preferred manner, at least two lugs disposed on opposite sides of the retainer are provided, which are, in particular, each formed in one piece with the respective wall. In addition, a configuration in which the lugs are disposed on the frame may be envisaged, wherein the lugs during the pushing-on of the frame are guided in such a manner as to at least partially penetrate into the storage body. Finally, the lugs for the fixation of the storage body within the retainer may also be pressed into the storage body by the user, either manually or by the aid of a suitable tool.

In another preferred embodiment of the invention, the engaging parts are formed by spacer projections provided on the frame, which hold the printing plate and the storage body at a distance from each other in the provisional mounting position and engage the storage body when moving the frame into the final mounting position. The spacer projections thus fulfil two tasks: In the provisional mounting position, the spacer projections serve to prevent any contact between the storage body and the text plate in that the storage body, separated from the text plate by the air gap, is immovably arranged between the retainer and the facing abutment surfaces of the spacer projections; as soon as the frame is pushed into the final mounting position, the spacer projections by their abutment surfaces will at first engage the storage body so as to achieve a fixed arrangement of the storage body within the ink storage unit.

In order to protect the printing plate from damage and contamination by dust particles or the like, it will be beneficial if a transparent protective foil is provided on the side of the printing plate facing away from the storage body. In that the protective foil is translucent, it may be left on the printing plate during exposure, thus advantageously preventing the printing plate from being soiled.

In a preferred manner, the protective foil is designed to be hood-shaped so as to correspond to the outer shape of the frame comprising the printing plate. The printing plate side facing away from the storage body is completely covered by the protective foil, wherein the protective foil, for the formation of the hood-shaped configuration, is raised over a certain extension along a frame wall arranged substantially perpendicularly to the printing plate.

In order to be able to pull off the protective foil in a simple manner, it will be beneficial if the protective foil comprises a gripping flap extending beyond an edge of the frame.

To fix the retainer comprising the storage body to the frame holding the printing plate, it will be beneficial if cooperating snap-in elements are each provided on the retainer and on the frame to define a first snap-in position corresponding to the provisional mounting position and a second snap-in position corresponding to the final mounting position. When mounting the storage unit, the frame is at first slipped on the retainer only to such an extent that the cooperating snap-in elements of the frame and the retainer will latch in the first snap-in position, in which the storage body and the printing plate are mutually spaced apart, or separated by an air gap, according to the provisional mounting position; for the transfer into the final mounting position, the frame is further pushed onto the retainer until the snap-in elements will be locked in the second snap-in position.

In a structurally simple configuration involving low production costs, it is provided that at least one snap-in element is comprised of two snap-in projections arranged one after the other in the transfer direction and preferably also mutually offset laterally, and at least one snap-in element cooperating therewith is formed by a snap-in hook, preferably a snap-in hook shared by the two snap-in projections, which overlaps one of the two snap-in projections as a function of the snap-in position. If the snap-in elements, or the frame and the retainer, are made of a synthetic material by injection molding, as is preferably the case, manufacturing advantages will be feasible by the lateral offset of the snap-in projections. The mentioned snap-in elements in the form of snap-in projections or snap-in hooks can be combined in any manner whatsoever; thus, it is, for instance, also possible to assign a separate snap-in hook to each of the snap-in projections. In a preferred manner, the snap-in projections are provided on the retainer and are overlapped by a single and accordingly wide snap-in hook provided on the frame. It may also be contemplated to interchange the positions of the snap-in projections and the snap-in hook such that the snap-in projections are disposed on the frame and the snap-in hook is disposed on the retainer.

The hand stamp according to the invention, which includes an actuating unit for moving the printing plate arranged in the retainer from the resting position retracted in the stamp housing into the printing position, is characterized in that the storage body is fixed in the retainer by at least one engaging part. In order to avoid repetitions, it is herewith referred to the explanations given in connection with the ink storage unit according to the invention.

In known hand stamps of the present type, it has been observed that the contact pressure by which the text plate and the storage body are pressed against each other during the exposure and thereafter is non-uniformly distributed due to unevennesses in the text plate, which may lead to an insufficient impregnation with ink at certain points of the text plate. In order to overcome this problem of known flash hand stamps and ensure the uniform application of pressure to the printing plate, it will be advantageous if an, in particular, softly elastic pressing plate, e.g. of polyurethane foam, is provided on the side of the printing plate facing away from the storage body, optionally separated by the transparent protective foil. The softly elastic pressing plate causes a constant contact pressure to be exerted over the entire surface of the printing plate, thus safeguarding sufficient impregnation of the printing plate with ink from the storage body. In this respect it has turned out to be of particular advantage if the pressing plate is pressed against the printing or text plate for a defined time exceeding the period of exposure, e.g. a total of ten minutes, in order to ensure thorough impregnation.

For the compact and protected arrangement of the individual components of the ink storage unit, it will be beneficial if, on the side of the pressing plate facing away from the printing plate, a cover is provided via an interposed, projecting strip of paper. Said strip of paper might also serve as an indicator that no thorough impregnation has yet occurred at the storage unit. After the printing plate has absorbed sufficient ink, the strip of paper can be removed to indicate that the ink storage unit is ready for making a print.

BRIEF DESCRIPTION OF THE DRAWINGS

In the following, the invention will be explained in even more detail by way of preferred exemplary embodiments illustrated in the drawing, to which it is, however, not to be restricted. In the drawing.

DETAILED DESCRIPTION OF THE EMBODIMENTS

Figure 1:
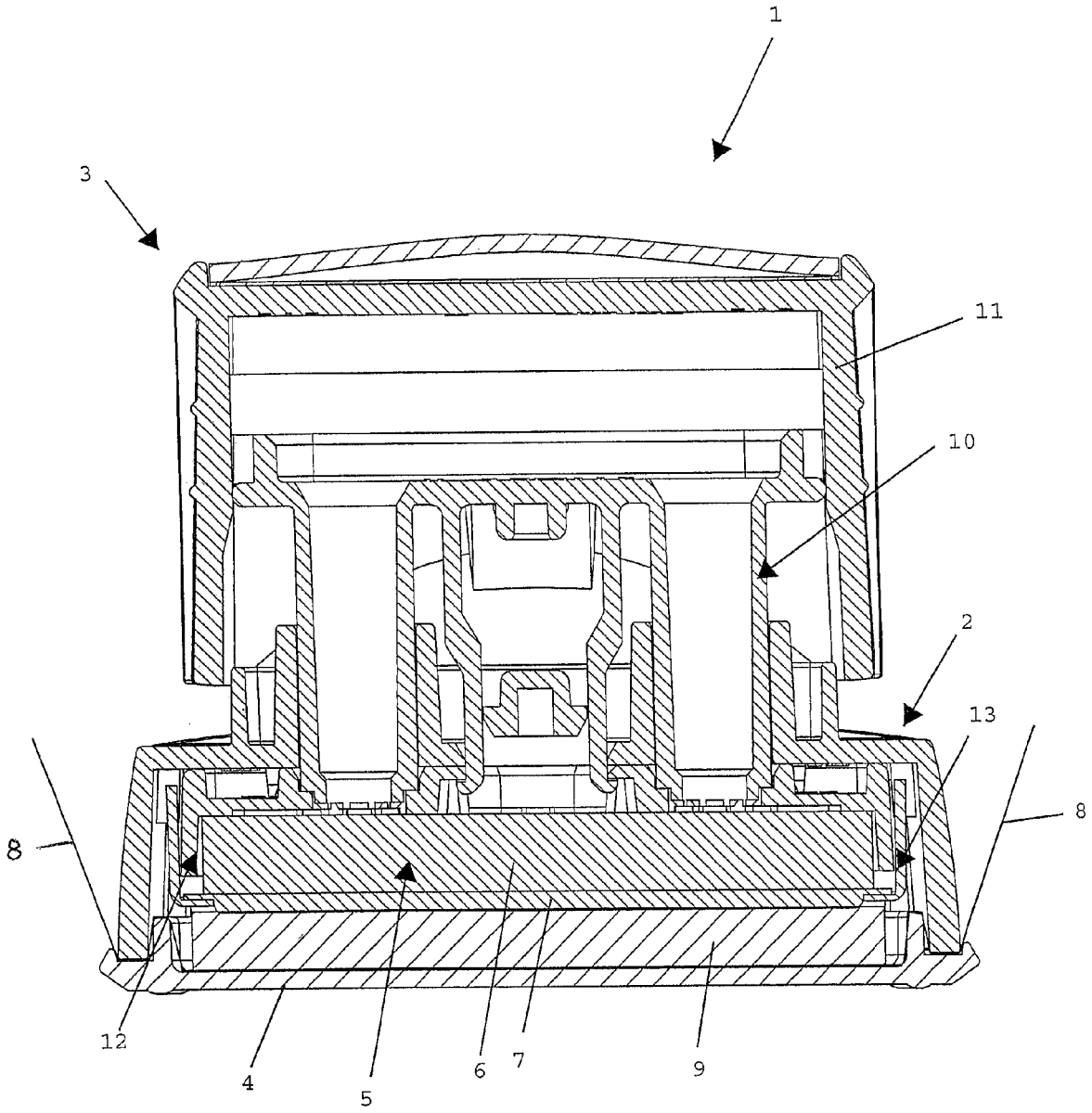
FIG. 1 depicts a longitudinal section through a pre-inked hand stamp comprising an ink storage unit.

FIG. 1 depicts a pre-inked hand stamp 1 including a (stamp) housing 2 and an actuating unit 3 and having a structure known per se, cf., e.g., AT 503 112 B1. To the lower side of the housing 2 is fastened a cover 4 protecting an ink storage unit 5 received in the interior of the housing 2 and comprising a printing plate 7 that is fed with ink by a storage body 6. The hand stamp 1 is illustrated in a state ready for delivery, which is indicated by a strip of paper 8 disposed on the inner side of the cover 4 and laterally projecting out of the housing 2.

In order be able to use the illustrated hand stamp 1, the cover 4 and a pressing plate 9 temporarily attached to the housing 2 and explained in more detail below in connection with the production of the printing plate 7 have to be removed.

To transfer the printing plate 7 from a resting position retracted in the housing 2 into a printing position, the actuating unit 3 is downwardly displaced against the action of a spring (not illustrated in FIG. 1) on a handle portion 11 interlocked with an internal connecting part 10. Incidentally, a comprehensive explanation of the actuating mechanism for making a print on a stamping surface can be renounced, and instead it is referred to AT 503 112 B1, in which the interaction of the individual parts of the actuating unit 3 is described in detail.

In the pre-inked hand stamp 1 according to the invention, a flash exposure is, in particular, provided to produce an individual stamp pattern on the printing plate 7. In doing so, the ink-storage unit 5 is introduced into an exposure machine in a manner known per se while providing a foil (not illustrated) that acts as a template, and is exposed to light flashes, e.g. for one or two minutes, to impress the desired stamp pattern into the printing plate 7 by partial melting. In order to sufficiently impregnate the printing plate 7 with ink in all areas, a uniform supply of ink by the ink storage unit 5 during and after the exposure will be required. To this end, the pressing plate 9, which is, for instance, made of a softly elastic polyurethane foam material, is supplied along with the hand stamp 1 as already mentioned above, said pressing plate being arranged in the housing 2 of the hand stamp 1 between the cover 4 and the printing plate 7 to firmly and uniformly press the printing or text plate 7 for some further minutes against the storage body 6 after the exposure operation.

The formation of the stamp pattern in the printing plate 7 requires the printing plate 7 to be prevented from being impregnated with ink from the storage body 6 prior to the exposure—at least on its front side.

To this end, the ink storage unit 5 is movable between a provisional mounting position, in which the printing plate 7 and the storage body 6 are spaced from each other, and a final mounting position, in which the printing plate 7 contacts the storage body 6.

Figure 2:
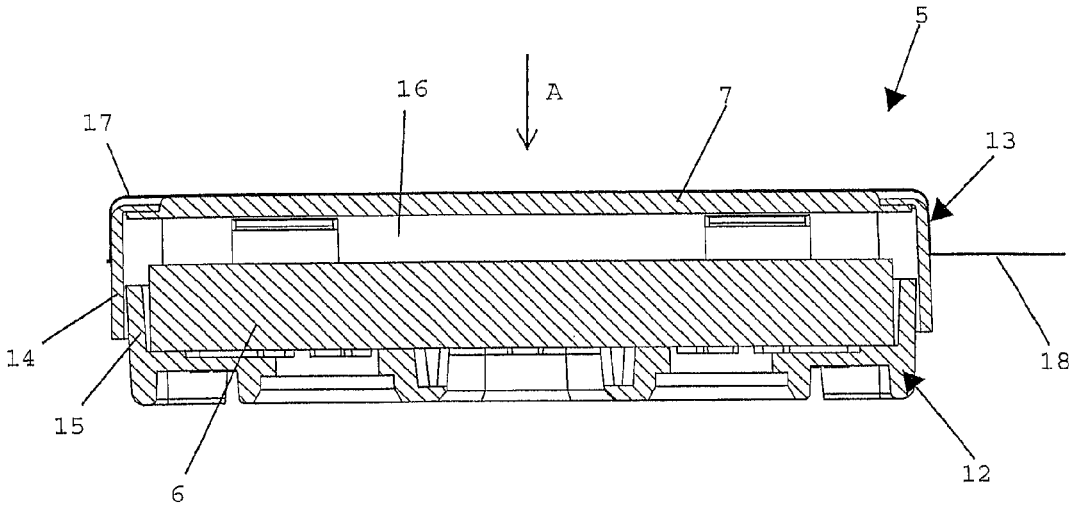
FIG. 2 depicts a longitudinal section through the ink storage unit according to FIG. 1 in a provisional mounting position, in which a printing plate disposed in a frame is arranged at a distance from a storage body received in a trough-shaped retainer.
Figure 3:
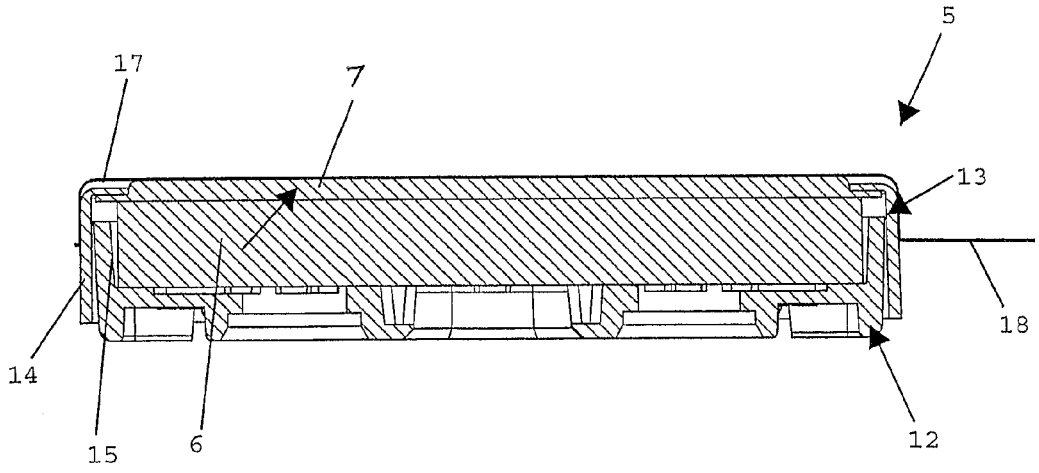
FIG. 3 depicts a longitudinal section similar to that of FIG. 2, with the frame having been slipped on the retainer into its final mounting position, in which the printing plate and the storage body contact each other.

As is apparent from FIGS. 2 and 3, the ink storage unit 5 comprises a trough-shaped retainer 12, in which the storage body 6 is received; the printing plate 7 is held in a frame 13 correspondingly designed in terms of shape. FIG. 2 illustrates the provisional mounting position of the ink storage unit 5, in which a wall 14 of the frame 13, which is angled substantially perpendicularly to the printing plate 7, is slipped on a respective wall 15 of the retainer 12 over a certain extension, with the printing plate 7 and the storage body 6 being separated by an air gap 16. For the transfer into the final mounting position depicted in FIG. 3, the frame 13 is completely slipped onto the retainer 12 in the sense of arrow A (FIG. 2) until the printing plate 7 and the storage body 6 contact each other.

FIGS. 2 and 3 additionally indicate a, for instance, transparent, hood-shaped protective foil 17 superimposed on the side of the printing plate 7 facing away from the storage body 6. Due to the translucent configuration of the protective foil 17, the protective foil 17 need not be removed during the exposure operation in the exposure machine. The protective foil 17 is bent off from the edge of the printing plate 7 along the wall 14 and comprises a gripping flap 18 on one side, which is, in particular, also apparent from FIGS. 14 and 15.

Figure 4:
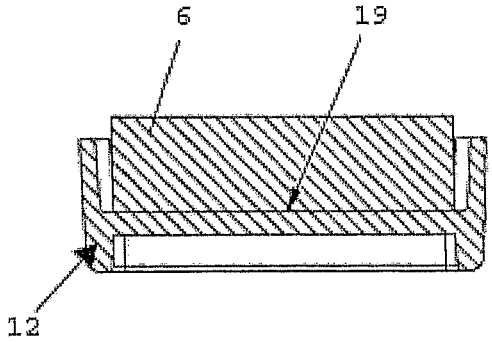
Fig. 4 (Prior Art)
FIG. 4 schematically illustrates a cross section through a retainer with a glued-in storage body according to the prior art.

The object of providing a safe fixation of the storage body 6 within the retainer 12 has only been insufficiently solved in the prior art. FIG. 4 schematically illustrates a retainer 12 according to the prior art, in which the storage body 6 is fastened to the support or bottom surface of the retainer 12 by an adhesive connection 19.

In order to avoid problems caused by the adhesive connection 19 and, in particular, a fixation that is unreliable during long-term use, or a limitation as to the selection of the materials that can be used for the production of the retainer 12, the retainer 12 according to the invention comprises at least one engaging part 20 to reliably fix the storage body 6 within the retainer 12.

Figure 5:
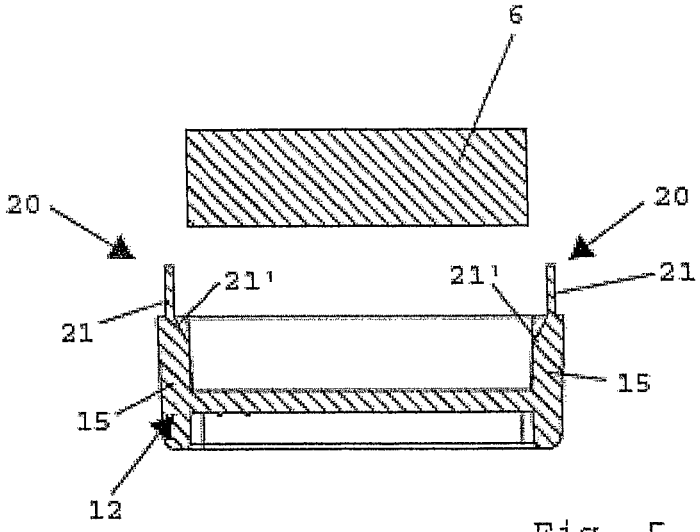
FIG. 5 is a sectional view of a retainer for receiving a storage body illustrated separately from the retainer, in which engaging parts in the form of two deformable lugs are provided according to one embodiment of the invention.
Figure 6:
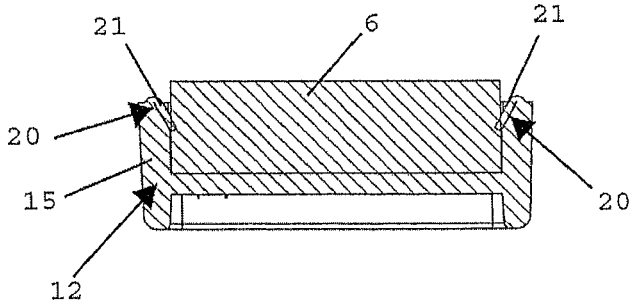
FIG. 6 is a sectional view according to FIG. 5, with the storage body introduced in the retainer and fixed by the lugs.

A first embodiment of the invention is illustrated in FIGS. 5 and 6, in which lugs 21 are oppositely arranged on the longitudinal sides of the retainer wall 15 as engaging parts 20, said lugs being made of a deformable material, in particular a synthetic material. As is apparent from FIG. 6, the lugs 21 are deformed or bent as the storage body 6 is inserted into the retainer 12. In the deformed or bent state, the lugs 21 engage the storage body 6 to prevent the storage body 6 from falling out of the retainer 12. In the preferred configuration illustrated, the lugs 21 are formed in one piece with the retaining walls 15 on their upper sides facing the frame 13, whereby the lugs 21 are pressed down, bent, and pressed into the storage body 6, by the frame wall 14 as the frame 13 is pushed on into the final mounting position. To facilitate this, a chamfer 21' is provided on the wall 15 adjacent the base of the respective lug 21.

FIGS. 7 to 10 depict an alternative embodiment of the engaging part 20 for fixing the storage body 6 within the retainer 12; in the present case, several engaging parts 20 (e.g. four provided in pairs) are, in particular, formed by spacer projections 22 provided on the frame 13.

Figure 7:
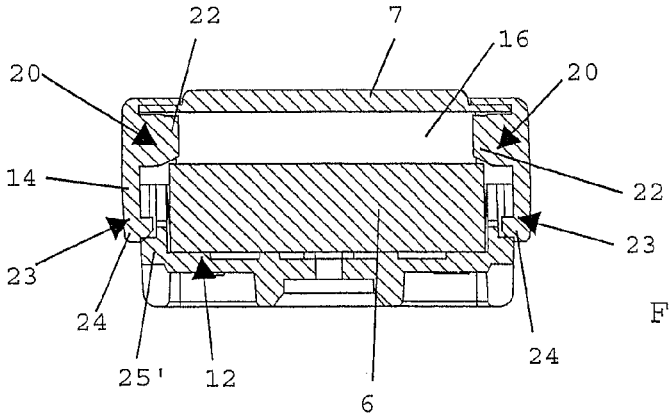
FIG. 7 depicts a cross section through an ink storage unit according to a further embodiment of the invention, in which the printing plate and the storage body are held in the provisional mounting position at a distance from each other by spacer projections provided on the frame.
Figure 8:
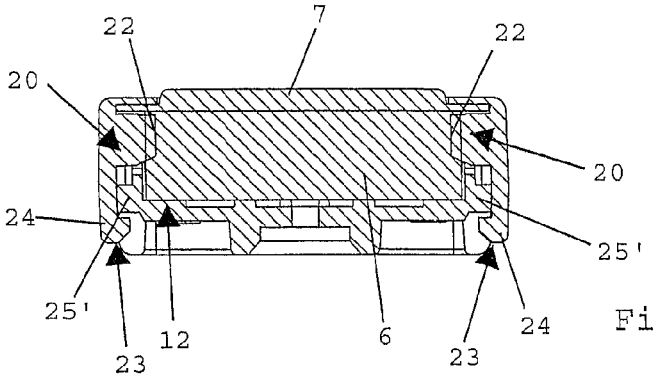
FIG. 8 depicts a cross section similar to that of FIG. 7, with the spacer projections fixing the storage body within the retainer in the final mounting position.
Figure 9:
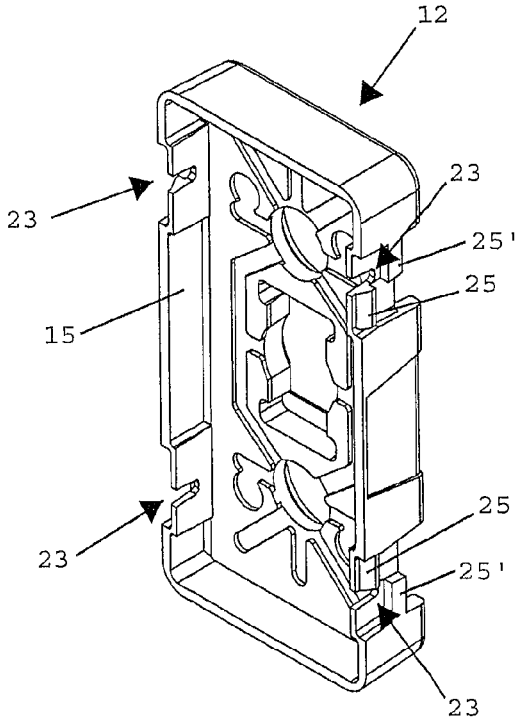
FIGS. 9 and 10 are each an elevational view of the retainer (FIG. 9) provided for receiving the storage body and of the frame (FIG. 10) provided for receiving the printing plate, with cooperating snap-in elements being visible.
Figure 10:
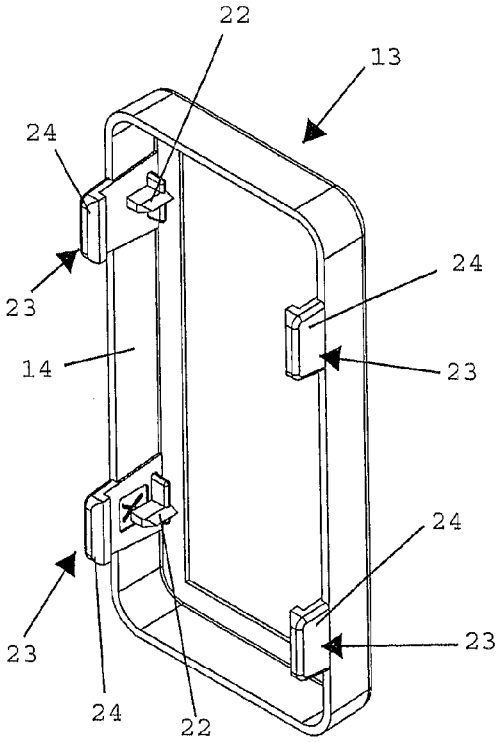
Figure 11:
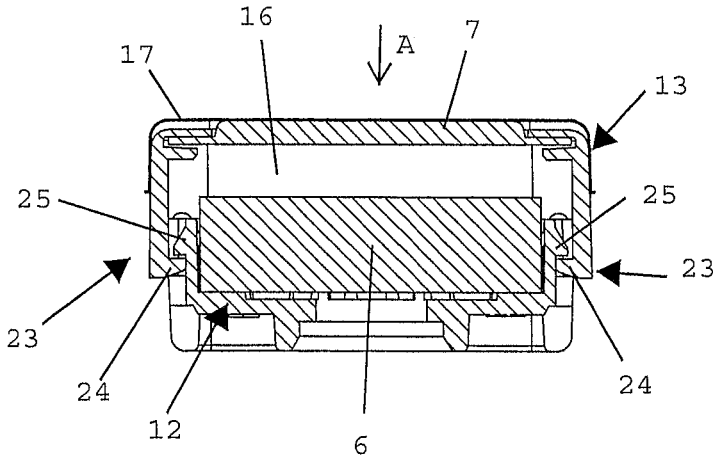
FIGS. 11 and 12 each depict a cross section (along a sectional plane outside the spacer projections, which is offset relative to FIGS. 7 and 8) through the ink storage unit according to FIGS. 7 to 10, in the provisional mounting position and in the final mounting position, respectively, with the cooperating snap-in elements being interlocked in a first snap-in position and in a second snap-in position, respectively.
Figure 12:
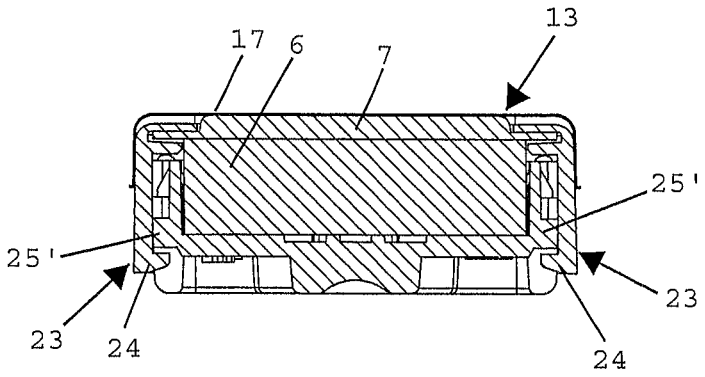

FIG. 7 and FIG. 8 each show a sectional view of the ink storage unit 5 in the region of a pair of oppositely located spacer projections 22 formed on the inner surfaces of the longitudinal sides of the frame wall 14, which are, in particular, also apparent from FIG. 10. In the provisional mounting position illustrated in FIG. 7, which is also referred to as intermediate position, the storage body 6 is held at a distance from the printing plate 7 by the spacer projections 22 in order to reliably prevent any undesired impregnation of the printing plate 7 with ink from the storage body 6 in the provisional mounting position. As the ink storage unit 5 is transferred into the final mounting position (cf. FIG. 8) in a flash or exposure machine either manually or automatically (by closing the lid of the flash machine), the spacer projections 22 enter into engagement with the storage body 6 so as to fix the storage body 6 within the retainer 12. The spacer projections 22 are configured as comparatively narrow, rib-shaped projections; as is apparent from FIG. 10, the end region of each spacer projection 22 provided to engage with the storage body 6 is tapered in a blade-like manner towards the storage body 6 so as to facilitate said engagement into the storage body 6.

As is further apparent from FIGS. 9 to 12 (and also partially from FIGS. 7 and 8), snap-in elements 23 are provided to fix the frame 13 on the retainer 12 in the intermediate position (FIGS. 7, 11) and in the final mounting position (FIGS. 8, 12), respectively. The snap-in elements 23, on the one hand, comprise snap-in hooks 24 arranged on longitudinal-side inner surfaces of the frame wall 14 and each projecting beyond the edge of the frame wall 14. Two snap-in projections 25, 25' of the retainer 12, which are arranged on the outer side of the retainer wall 15 in a mutually offset manner, are each associated to the snap-in hooks 24. The snap-in projections 25 define a first snap-in position, i.e. the intermediate position, and the snap-in projections 25' define a second snap-in position, i.e. the final mounting position. In the provisional mounting position (intermediate position), the retainer 12 and the frame 13 are snap-fit with each other in the first snap-in position of the snap-in elements 23, which is particularly apparent from FIG. 11 and in which the snap-in projections 25 are overlapped by the snap-in hooks 24; for the transfer into the final mounting position according to FIG. 12, the frame 13 is further pushed onto the retainer 12 in the sense of arrow A until the second snap-in position of the snap-in elements 23 is reached, in which the offset snap-in projections 25' are overlapped by the snap-in hooks 24, cf. FIG. 12. The width of the snap-in hooks 24 is designed to allow the joint snap-in hook 24 to overlap both the snap-in projection 25 in the first snap-in position and the snap-in projection 25', which is offset not only laterally but also in the push-on direction, in the second snap-in position. It would, of course, also be conceivable to provide mutually separated snap-in hooks, one each for one of the snap-in projections 25, 25', on the wall 14 of the frame 13 instead of one joint snap-in hook 24 each. The number and type of the cooperating snap-in elements 23 may also be varied.

Figure 13:
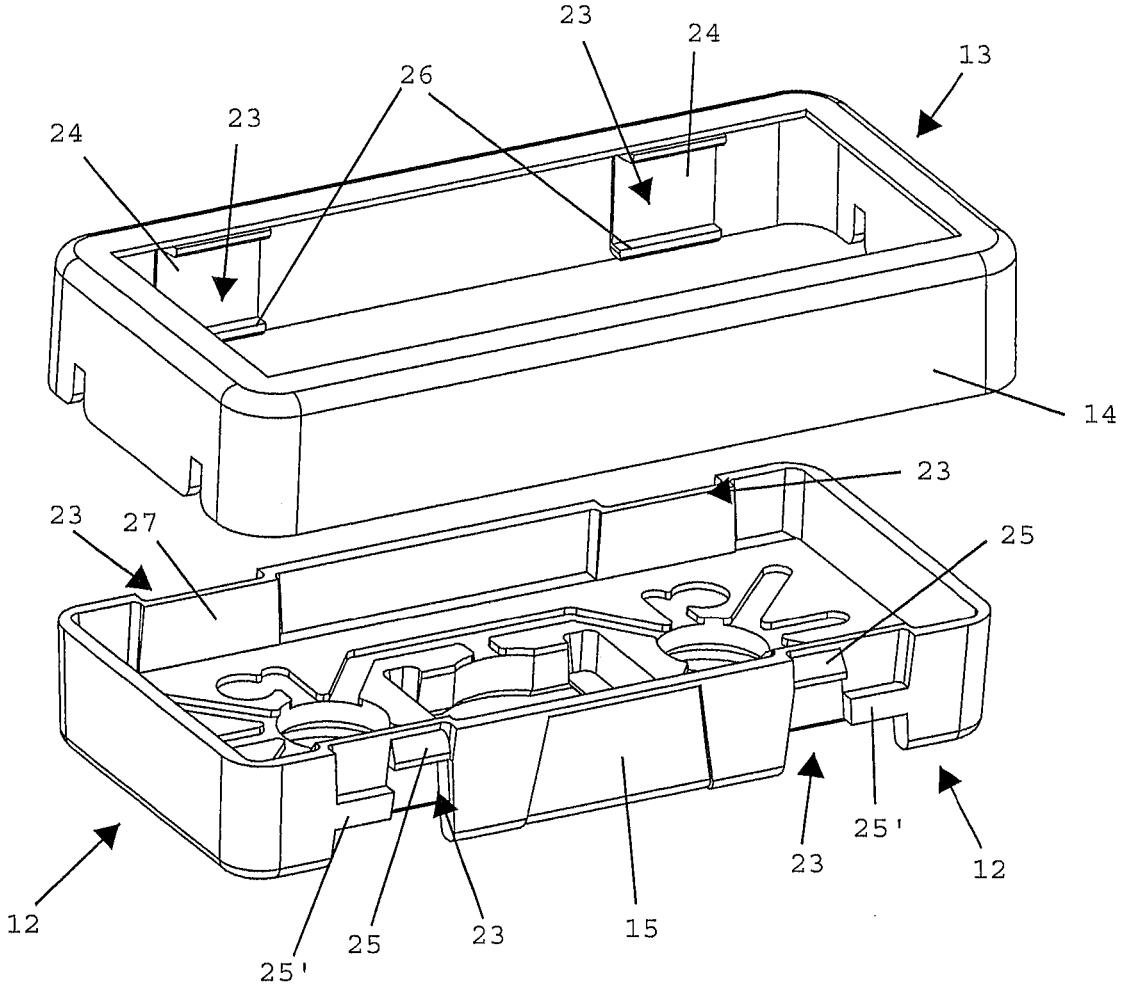
FIG. 13 is an exploded, elevational view illustrating the retainer apparent from FIGS. 7 to 12 for the storage body, and a frame according to an alternative embodiment.
Figure 14:
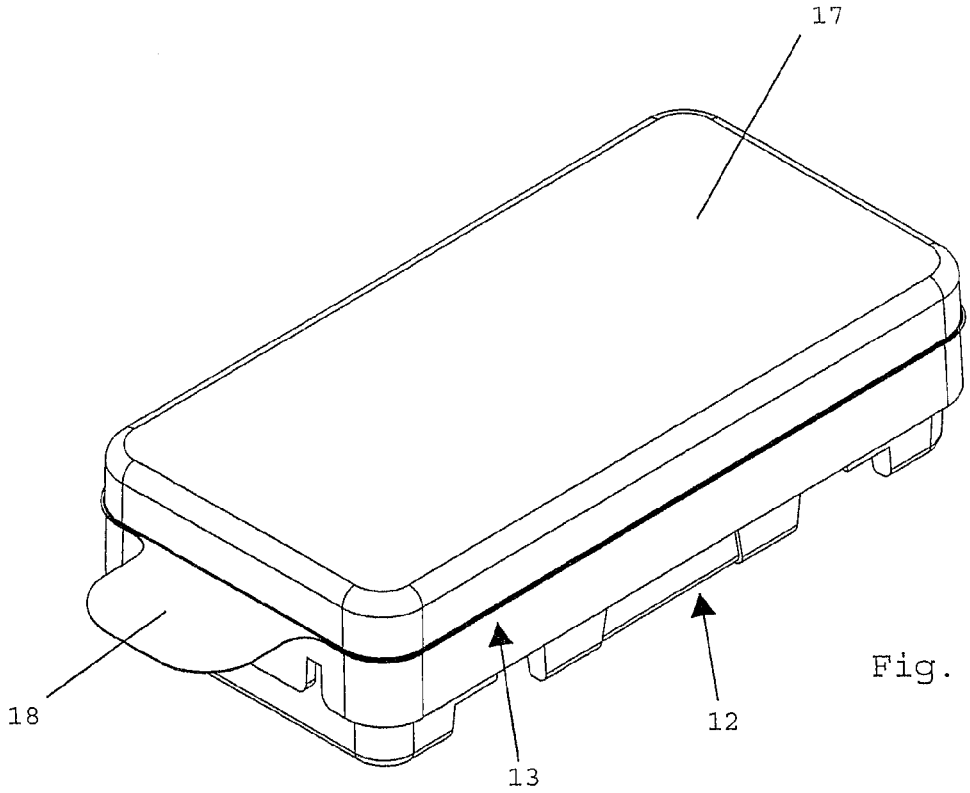
FIGS. 14 and 15 are each an elevational illustration of the assembled ink storage unit and frame formed according to FIG. 13 in the provisional mounting position, yet with a hood-shaped protective foil including a gripping flap being provided on the printing plate and its frame.
Figure 15:
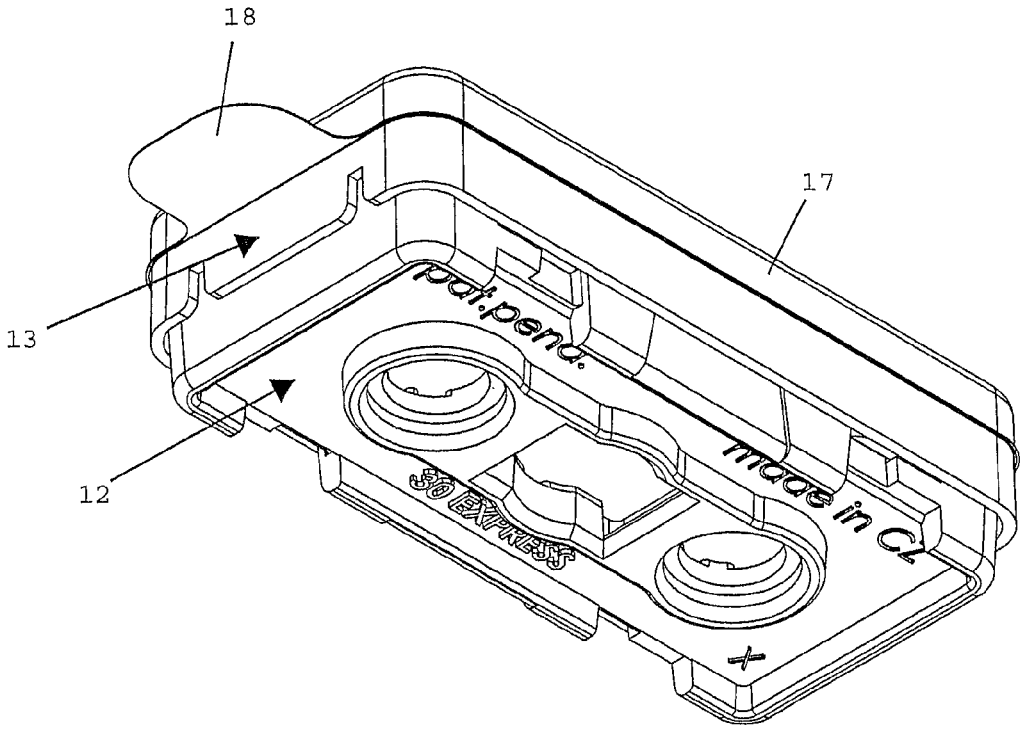

FIGS. 13 to 15 illustrate an ink storage unit 5 substantially corresponding to that of FIGS. 7 to 12, yet comprising a modified configuration of the frame 13. As is, in particular, apparent from FIG. 13, each of the snap-in hooks 24 in this configuration of the frame 13 comprises a snap-in ledge 26 that is flush with the edge of the frame wall 14 facing away from the printing plate 7 in the assembled state of the ink storage unit 5. Locking of the snap-in elements 23 both in the provisional mounting position as illustrated in FIGS. 14 and 15 and in the final mounting position is each effected in a similar manner as in the context of the exemplary embodiment discussed in respect to FIGS. 7 to 12, by the snap-in ledges of the snap-in hooks 24 engaging from behind the snap-in projections 25 in the first snap-in position and the snap-in projections 25' in the second snap-in position.

As is further apparent from FIGS. 14 and 15, the hood-shaped protective foil 17, which is transparent and may be left on its place during the exposure of the printing plate 7, is placed on the frame 13—in which the printing plate 7 is received.

Figure 16:
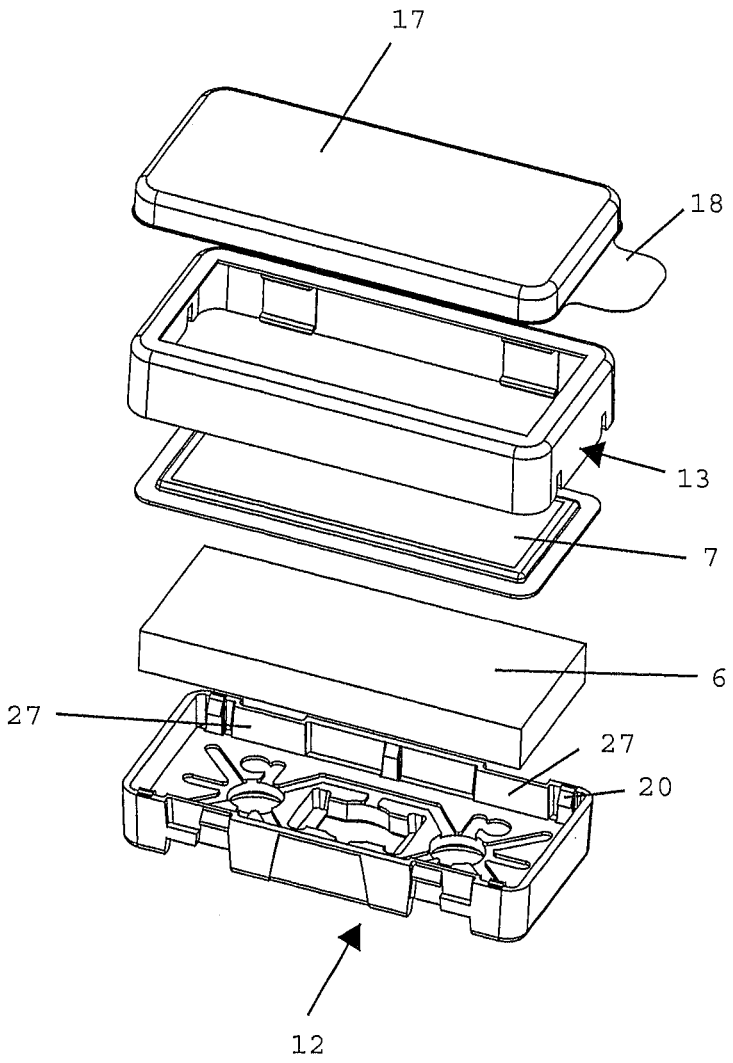
FIG. 16 is an exploded, elevational illustration of the individual components of the ink storage unit according to FIGS. 13 to 15.

FIG. 16, in an exploded view, finally shows the individual components of the ink storage unit 5, namely the retainer 12, the storage body 6, the printing or text plate 7, the frame 13, and the protective foil or hood 17.

The engaging parts 20 for fixing the storage body 6 within the retainer 12, for instance, comprise the inwardly projecting wall regions 27 provided in the region of the snap-in projections 25, 25', which may also extend in a slightly oblique manner and thus be "undercut", or—optionally additionally—separate, e.g. hook-shaped, engaging parts 20, which are formed in the corner regions of the retainer 12 in FIG. 16 by way of example.

What is claimed is:

1. An ink-storage unit (5) for a hand stamp (1), including a retainer (12) in which a storage body (6) is arranged, and a frame (13) in which a printing plate (7) is arranged, wherein the frame (13) sits in a provisional mounting position on the retainer (12), in which position the storage body (6) and the printing plate (7) are held at a distance from each other, and the frame (13) can be moved into a final mounting position on the retainer (12), in which position the storage body (6) and the printing plate (7) lie against each other, wherein the storage body (6) is fixed in the retainer (12) by at least one engaging part (20), wherein cooperating snap-in elements (23) are each provided on the retainer (12) and on the frame (13) to define a first snap-in position corresponding to the (13) provisional mounting position and ,d snap-in position corresponding to a final mounting position.

2. An ink-storage unit according to claim 1, wherein the engaging part (20) is comprised of lugs (21) provided on the retainer (12) and engaging the storage body (6) in a deformed or bent state.

3. An ink-storage unit according to claim 1, wherein a transparent, hood-shaped, protective foil (17) is provided on a side of the printing plate (7) facing away from the storage body (6).

4. An ink-storage unit according to claim 3, wherein the hood-shaped protective foil (17) comprises a gripping flap (18) extending beyond an edge of the frame (13).

5. An ink-storage unit according to claim 1, wherein at least one of the snap-in elements (23) is comprised of two snap-in projections (25, 25') arranged one after the other in the transfer direction and preferably also mutually offset laterally, and at least one snap-in element (23) cooperating therewith is formed by a snap-in hook (24), preferably a snap-in hook (24) shared by the two snap-in projections (25, 25'), which overlaps one of the two snap-in projections (25, 25') as a function of a snap-in position.

6. A hand stamp comprising an ink-storage unit according to claim 1 and including an actuating unit (3) for moving the printing plate (7) arranged in the retainer (12) from a resting position retracted in a stamp housing (2) into a printing position.

7. A hand stamp according to claim 6, wherein a softly elastic pressing plate (9), polyurethane foam, is provided on a side of the printing plate (7) facing away from the storage body (6).

8. A hand stamp according to claim 7, wherein on a side of the softly elastic pressing plate (9) facing away from the printing plate (7), a cover (4) is provided via an interposed, projecting strip of paper (8).

* * * * *

UNITED STATES PATENT AND TRADEMARK OFFICE

CERTIFICATE OF CORRECTION

PATENT NO. : 8,925,454 B2
APPLICATION NO. : 14/169366
DATED : January 6, 2015
INVENTOR(S) : Faber It is certified that error appears in the above-identified patent and that said Letters Patent is hereby corrected as shown below:

In the Claims

Column 8, Line 44 after the word "and", please delete ", d" and insert to correctly read:

--a second--.

Signed and Sealed this
Fourteenth Day of April, 2015

Michelle K. Lee

Michelle K. Lee
*Director of the United States Patent and Trademark Office*